US007516575B2

(12) United States Patent
Cuccurullo

(10) Patent No.: US 7,516,575 B2
(45) Date of Patent: Apr. 14, 2009

(54) ROOFTOP OPENING SAFETY RAILING

(76) Inventor: Joseph Cuccurullo, 19302 Cypress Rosehill, Tomball, TX (US) 77377

( * ) Notice: Subject to any disclaimer, the term of this patent is extended or adjusted under 35 U.S.C. 154(b) by 229 days.

(21) Appl. No.: 10/886,915

(22) Filed: Jul. 8, 2004

(65) Prior Publication Data

US 2005/0006634 A1 Jan. 13, 2005

Related U.S. Application Data

(60) Provisional application No. 60/485,418, filed on Jul. 8, 2003.

(51) Int. Cl.
*E02D 29/14* (2006.01)

(52) U.S. Cl. ..... 52/20; 52/200; 256/65.14; 256/68; 182/45; 182/113

(58) Field of Classification Search ..... 256/1, 256/DIG. 6, 69, 43–47, 65.01–65.04, 65.14; 182/112, 113, 45; 248/220.1; 52/20, 200, 52/DIG. 12, 19, 584.1, 651.1, 653.1, 655.1; 114/201 R; 403/262–263

See application file for complete search history.

(56) References Cited

U.S. PATENT DOCUMENTS

| | | | | |
|---|---|---|---|---|
| 2,389,899 | A * | 11/1945 | Deddo | 403/22 |
| 4,109,941 | A * | 8/1978 | Wood et al. | 285/111 |
| 5,098,047 | A * | 3/1992 | Plumley | 248/68.1 |
| D354,817 | S | 1/1995 | Kovacs et al. | D25/61 |
| 5,941,024 | A * | 8/1999 | Journault | 52/20 |
| 6,139,068 | A * | 10/2000 | Burress et al. | 285/92 |
| 6,167,659 | B1 | 1/2001 | Swindell, III | 52/20 |
| 6,209,271 | B1 | 4/2001 | Kovacs | 52/200 |
| 6,272,800 | B1 | 8/2001 | Phinney et al. | 52/200 |
| 6,467,230 | B1 * | 10/2002 | Perkins et al. | 52/655.1 |
| 6,477,972 | B2 * | 11/2002 | Perkins | 114/201 R |
| 6,681,528 | B1 * | 1/2004 | Profeta et al. | 52/20 |
| 6,688,046 | B2 * | 2/2004 | Perkins | 52/19 |
| 6,773,052 | B1 * | 8/2004 | Tyrer | 296/100.11 |
| 6,931,793 | B2 * | 8/2005 | Joyce et al. | 52/20 |
| 2004/0104382 | A1 * | 6/2004 | Collins et al. | |

* cited by examiner

*Primary Examiner*—Robert J Sandy
*Assistant Examiner*—Nahid Amiri
(74) *Attorney, Agent, or Firm*—James L. Jackson

(57) ABSTRACT

An improved safety railing for use with an opening in a rooftop or other location. The safety railing is easily securable to the curb, or upstanding wall, surrounding the opening. The securing mechanism of the safety railing also takes advantage of any outwardly protruding lip on the curb of the opening. The safety railing features a base portion that is reversibly securable to the curb portion of the opening and a railing portion that rises above the base portion. The base portion includes a pair of side members that are shaped and sized to abut the upstanding portion of the curb. Each of the curb members also present a surface to underlie the lip of the curb and engage it if the base portion is lifted. The base portion also includes two base members that interconnect the two side members. The base members are preferably formed of round hollow stock and have threaded nuts welded to each axial end. Threaded bolts are used to affix the side members to the base members. Further, the base portion of the device provides a somewhat flexible joint and pretensioning mechanism that preclude significant bending of the base members after significant use.

8 Claims, 5 Drawing Sheets

ROOFTOP OPENING SAFETY RAILING

This application claims the priority of U.S. provisional patent application Ser. No. 60/485,418 filed Jul. 8, 2003.

BACKGROUND OF THE INVENTION

1. Field of the Invention

The invention relates generally to fall protection devices. In particular aspects, the invention relates to devices and methods for providing secure safety railings around hatches, skylights and other openings that are typically found on rooftops, but which may also be found in floors or other areas.

2. Description of the Related Art

Railings and fall protection devices are important safety measures for use around rooftop openings, such as hatches. They ensure that persons passing through the opening have handholds and are intended to prevent a person from inadvertently falling into the opening. An example of a typical prior art safety arrangement is shown in U.S. Pat. No. 6,167,659 issued to Swindell, III, which describes a roof or access hatch safety system that is secured to the upstanding curb surrounding the hatch opening by screws. This arrangement has a number of disadvantages. First, it provides only two upstanding handles and no surrounding rail. Therefore, a person might fall into the opening from the side. Also, the safety handles are secured to the upstanding walls surrounding the opening using threaded screw-type connectors. Such connectors damage the opening since they penetrate it, thereby providing leakage points around the opening. Also, an error in the length of the connectors used can create a problem. If screws are used that are too long, they may present a puncturing hazard to persons or items passing through the opening. If screws that are too short are used, the handles may fall off of their mounting while being gripped by a person, allowing the person to fall downward through the opening and perhaps be injured.

U.S. Pat. No. 6,272,800 issued to Phinney et al. describes a safety railing protection device for rooftop openings and the like that does not utilize penetrating connectors to affix the device to the rooftop opening. Unfortunately, this device is unsteady in practice since it relies upon four clamps that grip each of the corners of the curb surrounding a rooftop opening. These clamps are secured by means of threaded tighteners. The railing itself is offset some distance from the corners of the curb that the clamps engage, thereby allowing significant play in the assembly. Over time, the railing may become unstable. Additionally, Phinney's device includes four outer legs with feet that rest upon the rooftop. Phinney suggests the use of measures to prevent the feet from digging into a roof, such as rounded edges on the feet. However, the fact that the railing may be pulled and pushed during use will virtually ensure that, over time, some damage will occur to the rooftop, regardless.

The inventors have learned that it is also desirable to provide a device that is easy to install in a minimum amount of time with few parts and with a minimum of effort. It is important to have a device that is secure and will remain secure over time, despite exposure to outside elements.

The present invention is directed to overcoming the problems of the prior art.

SUMMARY OF THE INVENTION

The present invention provides improved safety railings for use with an opening in a rooftop or other location. Safety railings are described that are easily securable to the curb, or upstanding wall, surrounding the opening. The securing mechanism of the safety railings also takes advantage of any outwardly protruding lip on the curb of the opening. In preferred embodiments described herein, the safety railing features a base portion that is reversibly securable to the curb portion of the opening and a railing portion that rises above the base portion. In one embodiment, the base portion includes side members with a square or rectangular cross-section that are shaped and sized to abut the upstanding portion of the curb. Each of these side members also present a surface to underlie the lip of the curb and engage it if the base portion is lifted. The base portion also includes two additional side members of rounded cross-section that interconnect these first two side members. The rounded base members are preferably formed of round hollow stock and have threaded nuts welded to each axial end. Threaded bolts are used to affix the side members to the base members. Further, the base portion of the device provides a somewhat flexible joint that precludes significant bending of the base members after significant use.

The base portion also features a unique pretensioning mechanism wherein a resilient material is provided upon central portions of the side members, but not upon the end portions of the side members. When the base portion is tightened around the curb, the resilient material is compressed in a manner that ensures a secure gripping arrangement against the curb.

In an alternative embodiment, the base portion is constructed of four base members that are secured to one another by corner bracket members that engage the opening to provide a secure gripping arrangement.

BRIEF DESCRIPTION OF THE DRAWINGS

For detailed understanding of the invention, reference is made to the following detailed description of the preferred embodiments, taken in conjunction with the accompanying drawings in which reference characters designate like or similar elements throughout the several figures of the drawings.

DETAILED DESCRIPTION OF THE PREFERRED EMBODIMENTS

Figure 1:
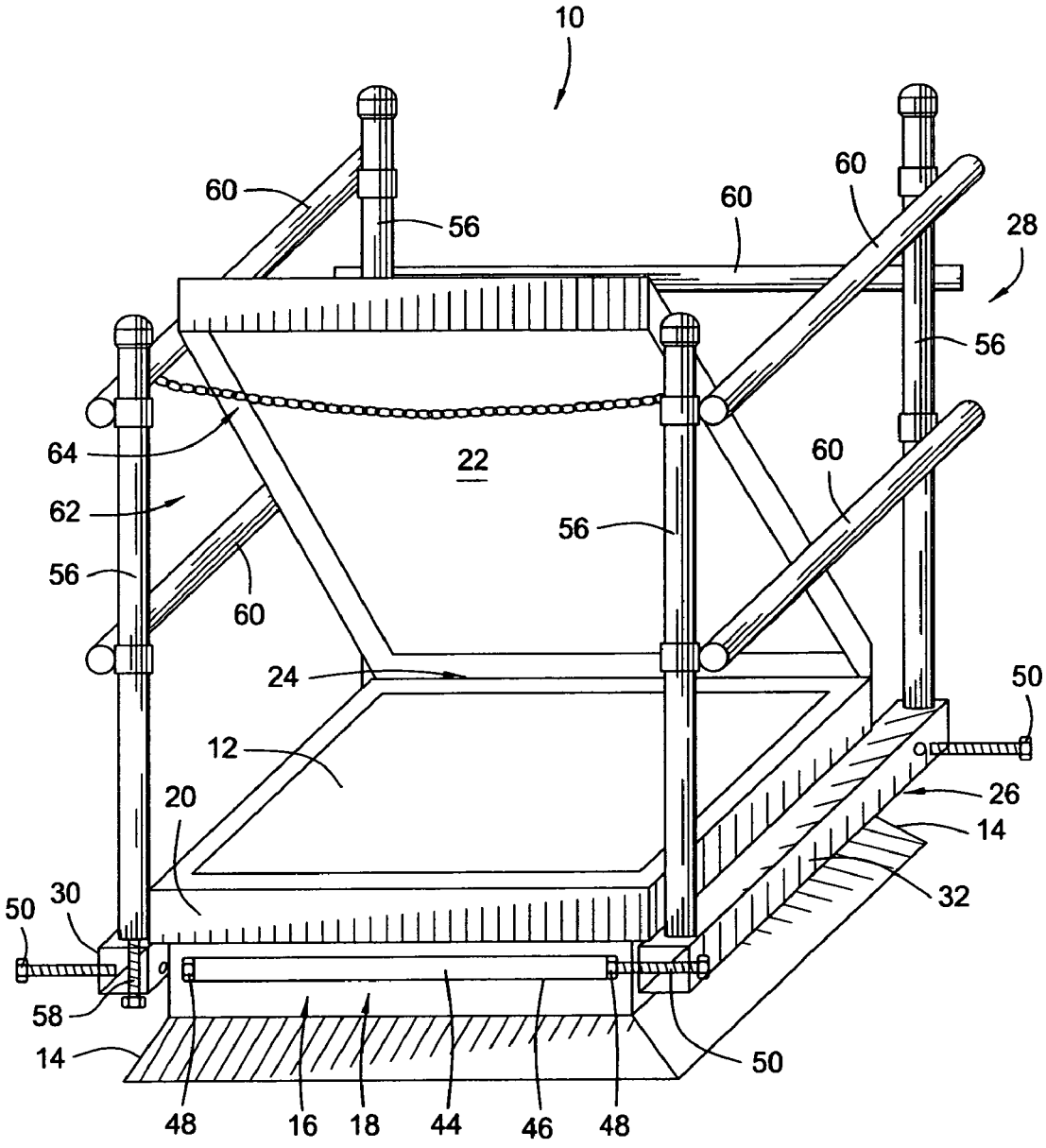
FIG. 1 is a partially exploded, isometric view of an exemplary rooftop opening safety railing constructed in accordance with the present invention.
Figure 2:
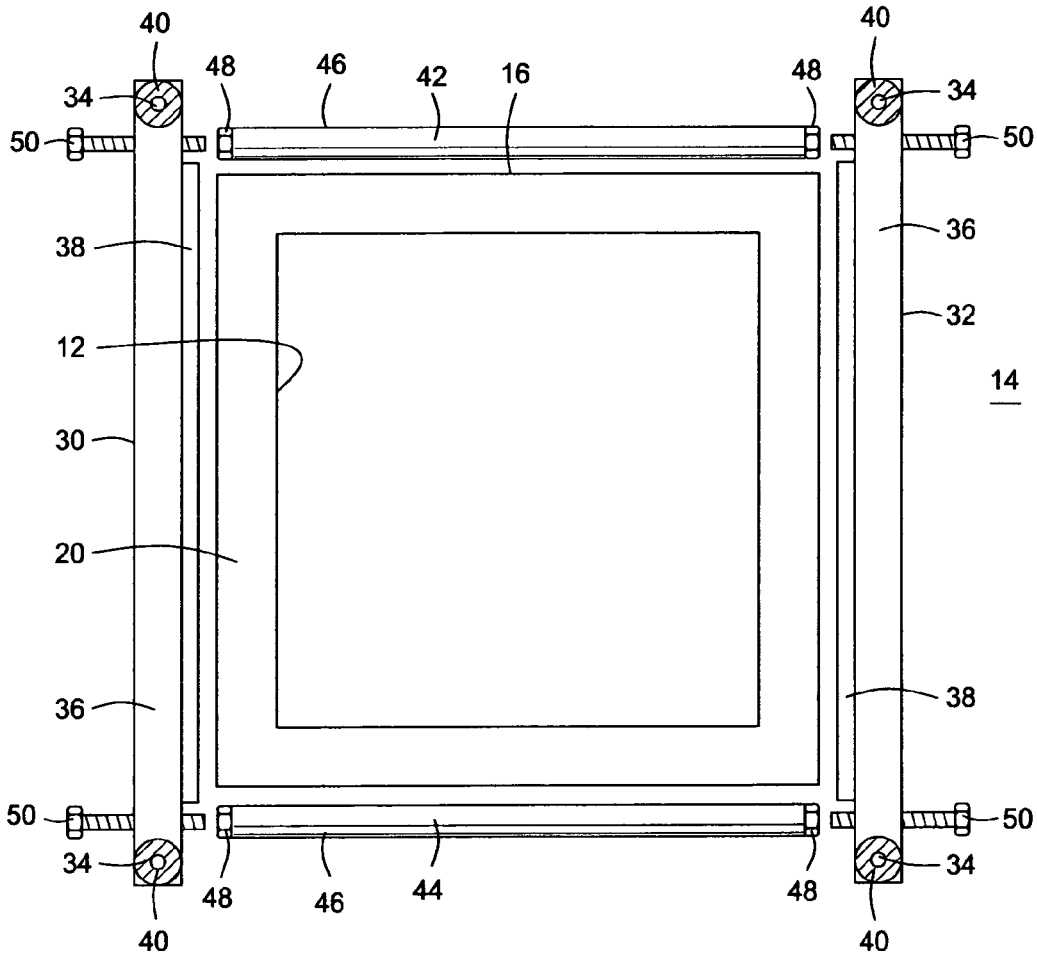
FIG. 2 is an exploded plan view depicting attachment of the base portion to an opening.
Figure 3:
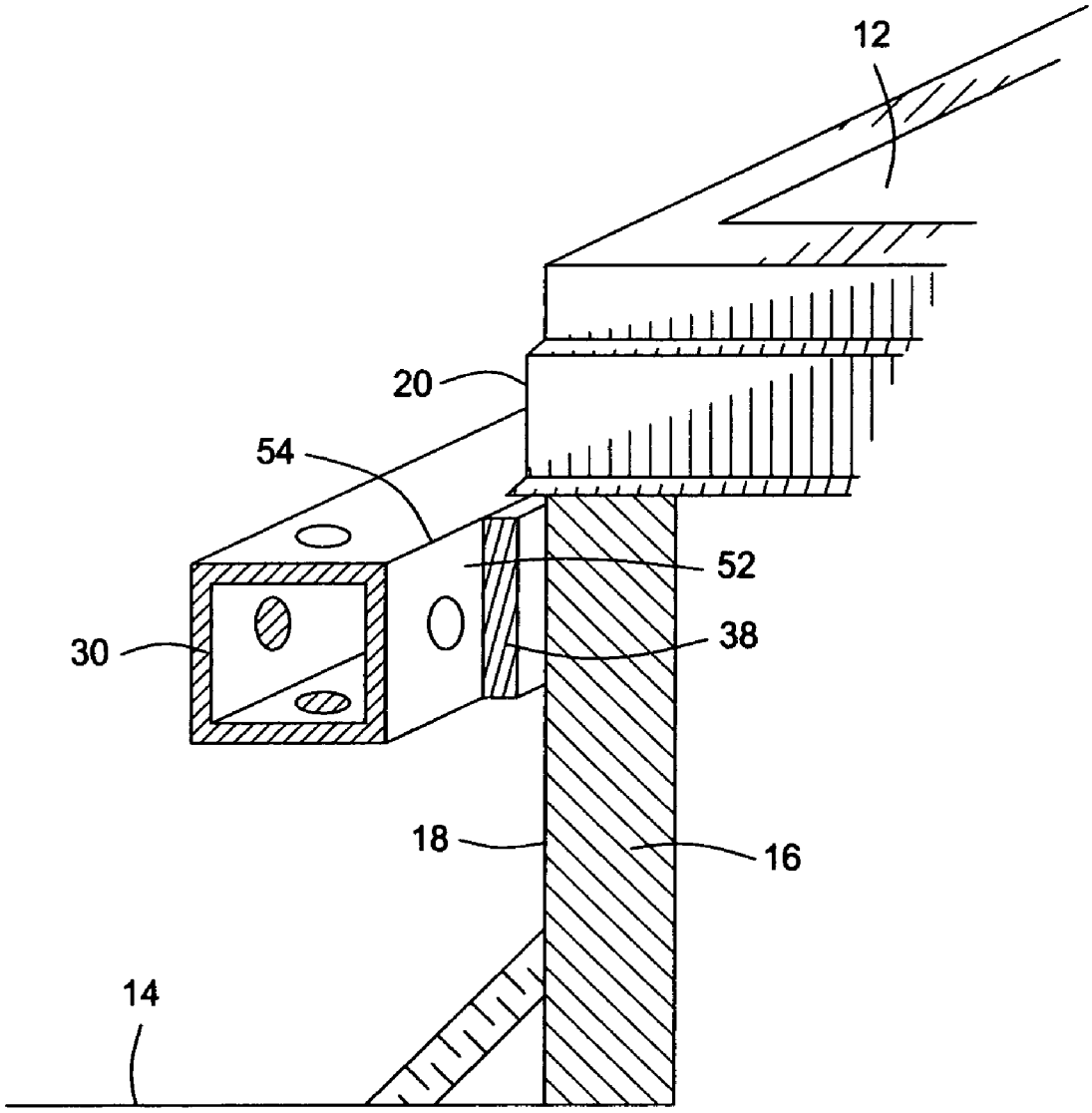
FIG. 3 is a detail depicting the gripping arrangement used to affix a side member to the curb of an opening.

FIGS. 1-3 depict a first exemplary rooftop opening safety railing 10 in accordance with the present invention. It will be understood, however, that the safety railing 10 may also have equal applicability to openings that are disposed in floors or locations other than a rooftop and that the rooftop locale is merely provided by way of example to illustrate the invention. FIGS. 1 and 2 show an opening 12 that is disposed in a rooftop 14. The opening 12 has a curb 16 that surrounds the opening 12. The curb 16 has an upstanding wall portion 18 and an outwardly projecting lip 20. Such lips 20 are common on rooftop openings, although not present on all such openings.

It is noted that the safety railing 10 is useful for either type of opening, although it is particularly useful for those having outwardly protruding lips. The opening 12 that is shown is a roof hatch, having a hatch cover 22 that may be pivoted about hinge 24 to be selectively opened and closed. The opening 12 often contains a ladder (not shown) by which a person on the roof may descend into the building. It is noted that the safety railing 10 may also be used with other openings, such as skylights.

The safety railing 10 includes a base portion, generally shown at 26, and a railing portion 28 that extends upwardly therefrom. The base portion 26 includes a pair of side members 30, 32 that are each preferably formed of a box beam having a hollow square or rectangular cross-section. As FIG. 2 best shows, the side members 30, 32 each present two axial end portions 34 and a central portion 36. A strip 38 of resilient material, such as compressible foam padding, is affixed to the central portion 36 of the each of the side members 30, 32. However, there is preferably no resilient material present upon either of the axial end portions 34 of either side member 30, 32. The end portions 34 of each of the side members 30, 32 contain openings 40 (see FIG. 2) for the insertion of poles or connectors used for the attachment of the railing portion 28. As FIGS. 1 and 2 illustrate, the side members 30, 32 are disposed upon either lateral side of the opening 12.

The base portion 26 also includes a second pair of side members 42, 44. Each of the side members 42, 44 interconnects the side members 30, 32 to one another. In a currently preferred embodiment, the side members 42, 44 each are constructed of a section 46 of hollow tubular stock and have a nut 48 secured to each axial end thereof by welding or another suitable method. The nuts 48 have an interior thread, as is known in the art, for receiving a complimentary threaded member therein. Threaded bolts 50 affix the end portions 34 of the side members 30, 32 to the nuts 48, as illustrated in FIGS. 1 and 2. The structure of the side members 42, 44, and the use of bolts 50 is particularly advantageous since it provides a somewhat flexible joint in attachment that prevents significant bending of the side members after a period of use and in response to bending and torsional forces that tend to be exerted upon the interconnection of the side members 30, 32 and the side members 42, 44. Such bending of the side members is undesirable since it could lead to a looseness of the safety railing 10 around the opening 12. Because the section 46 of each side member 42, 44 is hollow, the threaded ends of the bolts 50 are permitted some movement within the section 46. Therefore, torsional and bending forces upon the base portion 26 of the safety railing 10 will tend to be absorbed by the bolts 50. If, however, a solid bar were to be used instead of the hollow section 46 and affixed nuts 48, the solid bar would tend to bend and warp over time.

FIG. 3 illustrates the gripping arrangement of side member 30 against the curb 16 of the opening 12. As shown there, the side member 30 features a first abutting surface 52 that will lie adjacent and be compressed against the upstanding portion 18 of the curb 16 once the bolts 50 are tightened. The side member 30 also presents an upper locking surface 54 that will engage the underside of lip 20 if the base portion 26 is lifted upwardly with respect to the curb 16. The side members 42 and 44 and their respective nuts 48 and threaded connector bolts 50 thus serve as clamping or gripping force applying members that, upon threading of the bolts into the fixed nuts, function to mechanically urge curb contact surfaces of the side members 30 and 32 into clamping or gripping relation with upstanding wall portions of the curb of a roof opening hatch. This feature permits the establishment of clamping or gripping attachment of a safety rail system to the curb of a roof opening hatch without requiring the typical necessity of employing fasteners that penetrate the upstanding roof hatch curb.

Referring again to FIG. 1, the railing portion 28 of the safety railing 10 includes four upstanding posts 56. The posts 56 are secured to the side members 30, 32 of the base portion 26 by threaded connectors 58 (one shown). Several side braces 60 interconnect the posts 56 together and provide handholds and safety rails. The forward portion 62 of the railing portion 28 is, instead, provided with a chain 64, or rope or similar blocking means that can be easily disengaged from one of the two posts 56 and reengaged to selectively permit persons to pass through the safety railing 10.

In operation, the safety railing 10 is secured to the opening 12 by first assembling the base portion 26. This is done by disposing the side members 30, 32 alongside the two lateral sides of the upstanding portions 18 of the curb 16 of the opening 12. Then the side members 42, 44 are disposed upon the forward and rearward sides of the opening 12. The side members 42, 44 are then secured to the side members 30, 32 using the connectors 50, which are tightened to compress the resilient material strips 38. This results in a compression gripping arrangement by the abutting surface 52 of each side member 30, 32 against an upstanding portion 18 of the curb 16. Also, the curb 16 is not penetrated by any connectors, such as screws. Compression of the resilient strip 38 ensures that the gripping arrangement will remain secure over time, and will help absorb shocks and forces imparted to the safety railing 10 through use. Additionally, the upper locking surface 54 of the side members 30, 32 will engage the underside of a lip 20 (if present), if the safety railing 10 is lifted upwardly, thereby creating an even more secure attachment.

Figure 4:
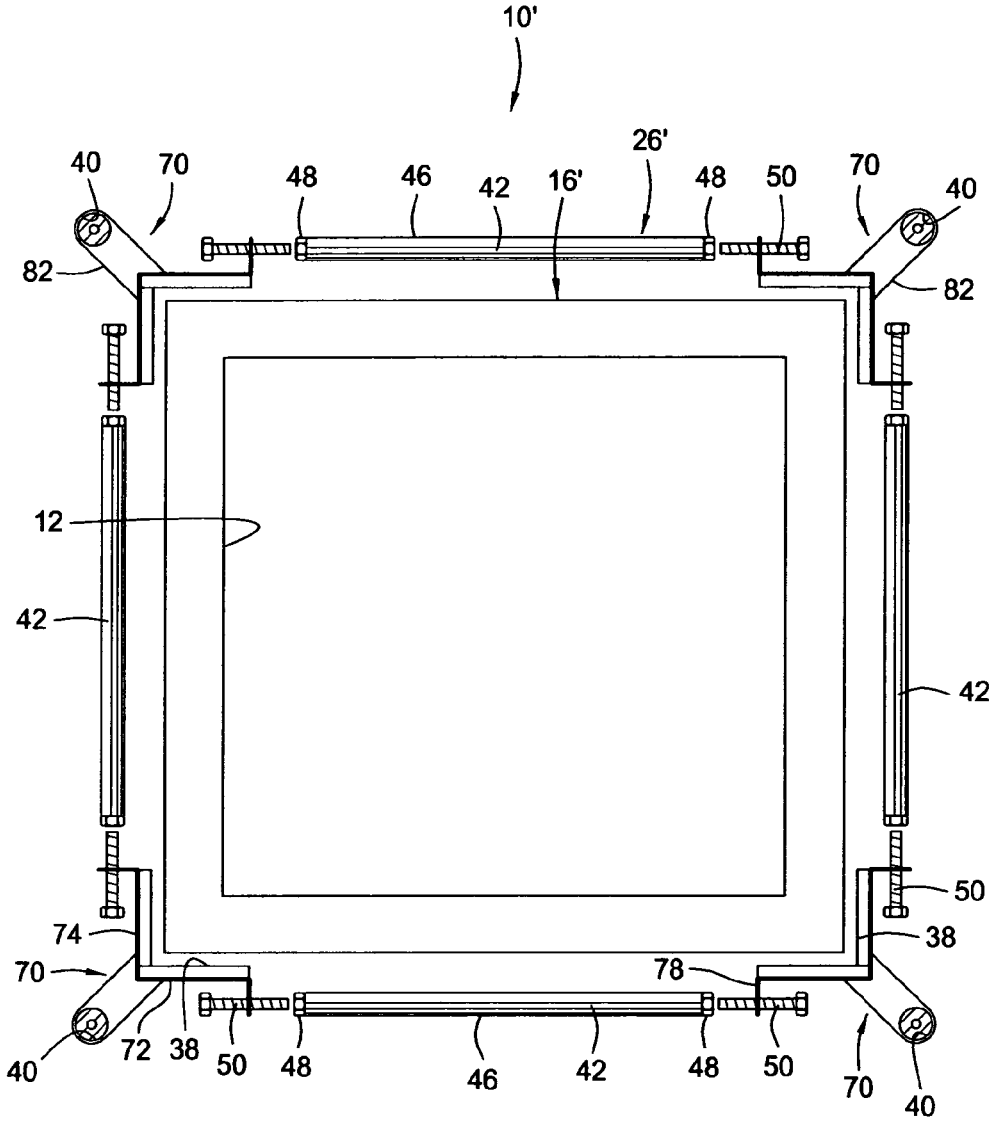
FIG. 4 is a partially exploded plan view of an alternative base portion of a safety railing surrounding an opening.
Figure 5:
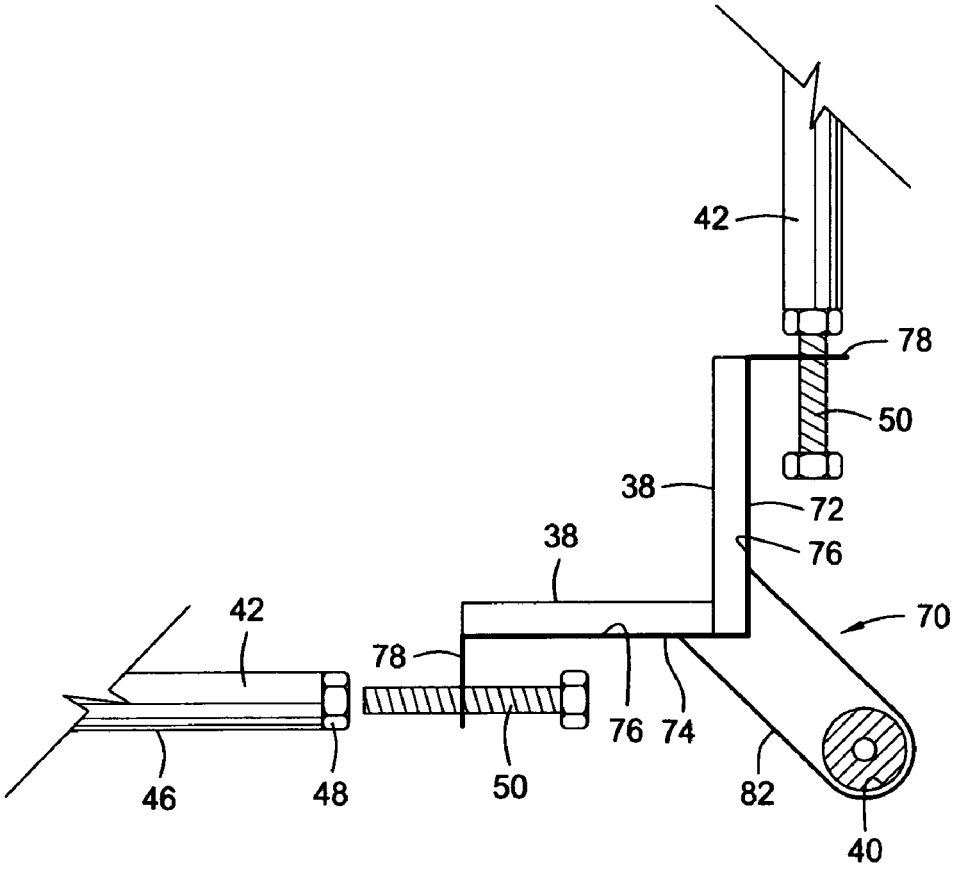
FIG. 5 is a detail plan view of a corner of the base portion shown in FIG. 4.
Figure 6:
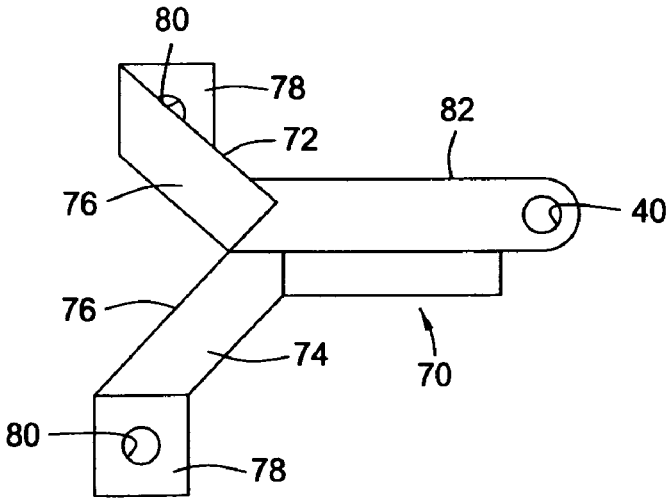
FIG. 6 is an isometric view of an exemplary corner bracket used in the safety railing shown in FIGS. 4 and 5.

FIGS. 4-6 depict an alternative base portion 26' for use in securing alternative railing 10' to an opening 12. Except where noted, construction and operation of the safety railings 10 and 10' are identical. Like components between the two embodiments are given like reference numerals. The base portion 26' includes four base members 42 which are secured at each axial end to a corner bracket member 70. FIGS. 5 and 6 illustrate details of the corner bracket member 70 in greater detail. The corner bracket member 70 includes a pair of engagement arms 72, 74 that diverge at an approximate right angle to one another. Resilient material strips 38 are affixed to the gripping sides 76 of the engagement arms 72, 74, as FIGS. 4 and 5 show. Flanges 78 are provided at the distal ends of each of the arms 72, 74 and contain apertures 80 through which a connector 50 maybe disposed. A pole support arm 82 extends from the junction of the engagement arms 72, 74 and includes, at its distal end, a receptacle 40 for receipt of a connector (not shown) for a support pole, such as pole 56 described earlier.

In operation, the corner bracket members 70 engage the opening 12 beneath the outwardly extending lip 20. When the connectors 50 are tightened, the base portion 26' will become secured in a compression gripping arrangement to the opening 12.

Safety railings constructed in accordance with the present invention provides a number of significant advantages over prior art devices. First, person affixing the safety railing 10 to the opening 12 may do so with a minimum of effort and without having to penetrate the rooftop 14 or the curb 16 with connectors, such as screws. Minimal time, parts, or instruction is required.

Those of skill in the art will recognize that numerous modifications and changes may be made to the exemplary designs and embodiments described herein and that the invention is limited only by the claims that follow and any equivalents thereof.

What is claimed is:

1. A rooftop hatch and safety railing assembly, comprising:

a rooftop hatch defining an opening and having an upwardly projecting generally rectangular curb having an upstanding wall portion having generally parallel upstanding curb wall members;

a railing portion having a plurality of upstanding posts and side braces interconnecting the posts and defining a safety railing;

a base portion being mounted to said safety railing portion and comprising a pair of elongate first side members each having an elongate clamping surface disposed adjacent one of said generally parallel upstanding curb wall members of said upwardly projecting generally rectangular curb of said rooftop hatch, said elongate first side members each having a pair of end portions, said base portion and said safety railing defining a safety railing assembly;

a pair of elongate clamp force applying second side members each defining opposed end portions having clamp force applying connection with respective end portions of said pair of first side members and being adjustable for applying clamping force to said elongate first side members and urging said elongate clamping surfaces of said first side members into immovable clamping engagement with said generally parallel upstanding curb wall members of said upwardly projecting curb of said rooftop hatch and supporting said safety railing assembly solely by clamping engagement with said generally parallel upstanding curb wall members of said upwardly projecting curb;

an outwardly projecting lip being defined by said upwardly projecting generally rectangular curb and having a downwardly facing shoulder located on said upstanding wall portion; and said elongate clamping surface of each of said first side members each being an elongate abutting surface disposed in abutting relation with an upstanding curb wall portion of said upwardly projecting generally rectangular curb of said rooftop hatch and defining a locking surface disposed in supporting engagement with said outwardly projecting lip of said upwardly projecting generally rectangular curb of said rooftop hatch.

2. The rooftop hatch and safety railing of claim 1 further comprising:

said opposed end portions of said pair of elongate clamp force applying second side members each having adjustable connectors mounted thereto and being adjustable to urge said elongate clamp force applying second side members toward one another and establishing clamping engagement of said elongate clamping surfaces of said first side members with said generally parallel upstanding curb wall members of said upwardly projecting generally rectangular curb of said rooftop hatch.

3. The roof hatch and safety railing of claim 1 further comprising:

a strip of resilient material disposed upon said elongate clamping and abutting surface of each of said first side members and being urged by said clamp force applying second side members into intimate force transmitting clamping contact with said upstanding wall portion of said upwardly projecting generally rectangular curb.

4. The roof hatch and safety railing of claim 3 wherein each of said elongate first side members comprises:

an axial end portion and an elongate central portion disposed therebetween, said elongate central portion defining said elongate clamping surface and wherein the strip of resilient material is disposed only upon the elongate central portion.

5. The rooftop hatch and safety railing of claim 1 wherein each of said clamp force applying second side members comprises:

a section of hollow tubing having two axial ends;

a nut secured to each axial end; and connector bolts extending through said first side members and being threaded into said nuts and being tightened to apply said clamping force to said elongate first side members and clamping said base portion of said safety rail assembly to said generally parallel upstanding curb wall members of said upwardly projecting generally rectangular curb.

6. A safety railing and rooftop hatch assembly comprising:

a generally rectangular rooftop hatch defining an opening and having an upwardly projecting generally rectangular curb having a pair of spaced generally parallel upstanding curb wall members;

a railing portion having a plurality of upstanding posts and at least one side brace interconnecting the upstanding posts and presenting a safety railing;

a base portion having clamping engagement to said upwardly projecting generally rectangular curb of said generally rectangular rooftop hatch, the base portion having a pair of elongate first side members of generally rectangular cross-sectional configuration disposed in abutting relation with said pair of spaced generally parallel upstanding curb wall members of said upwardly projecting generally rectangular curb, said railing portion and said base portion defining a safety railing assembly;

each of said first side members presenting an elongate clamping surface to abut and provide clamping engagement with one of said pair of spaced generally parallel upstanding curb wall members of said upwardly projecting generally rectangular curb;

a strip of resilient material disposed upon said elongate clamping surface of each of said first side members and establishing compressive clamping and gripping engagement with said generally parallel curb wall members of said upstanding curb of said rooftop hatch;

a pair of second side members each being an elongate clamp force applying member and having force transmitting engagement with end portions of said first side members and being mechanically adjustable for applying clamping force to said first side members and urging said strip of resilient material of each of said first side members into compressive gripping engagement with said generally parallel curb wall members of said upwardly projecting curb of said rooftop hatch and supporting said base portion and said railing portion solely by said upstanding curb of said rooftop hatch;

said elongate clamp force applying members each having a section of hollow tubing defining opposed ends; and threaded clamp bolt connectors having threaded engagement with said opposed ends and extending through said first side members and being threadedly adjustable for applying clamping force to said first side members and clamping said first side members in immoveable supported engagement with said generally parallel curb wall members of said generally rectangular upstanding curb.

7. The safety railing and rooftop hatch assembly of claim 6, comprising:

said pair of elongate clamp force applying members each defining ends and having a threaded nut fixed to each of said ends and receiving one of said threaded clamp bolt connectors in threaded clamp force applying engagement therewith.

8. The safety railing and rooftop hatch assembly of claim 7, comprising:

said elongate first side members being secured to each other by said threaded clamp bolt connectors engaging within said threaded nuts and providing flexible joints capable of absorbing torsional and bending forces that might otherwise bend a base member.

* * * * *